US009115486B2

(12) United States Patent
Rakoczy et al.

(10) Patent No.: US 9,115,486 B2
(45) Date of Patent: Aug. 25, 2015

(54) PUMP ASSEMBLY FOR A MARINE TOILET AND TOILET PUMP CONNECTION SYSTEM

(75) Inventors: Steve Rakoczy, Perth (AU); Steven Thomas McGuinness, Perth (AU)

(73) Assignee: Almos Technologies Pty. Ltd., Perth (AU)

( * ) Notice: Subject to any disclaimer, the term of this patent is extended or adjusted under 35 U.S.C. 154(b) by 538 days.

(21) Appl. No.: 13/579,268

(22) PCT Filed: Feb. 14, 2011

(86) PCT No.: PCT/EP2011/052118

§ 371 (c)(1),
(2), (4) Date: Sep. 18, 2012

(87) PCT Pub. No.: WO2011/101309

PCT Pub. Date: Aug. 25, 2011

(65) Prior Publication Data

US 2013/0205489 A1 Aug. 15, 2013

(30) Foreign Application Priority Data

Feb. 16, 2010 (EP) ..... 10153745
Apr. 13, 2010 (EP) ..... 10159783

(51) Int. Cl.
*E03D 11/00* (2006.01)
*E03D 5/01* (2006.01)
*B63B 29/14* (2006.01)

(52) U.S. Cl.
CPC .. *E03D 5/01* (2013.01); *B63B 29/14* (2013.01)

(58) Field of Classification Search
CPC ..... B63B 29/14; E03D 5/01; A47K 11/02; A47K 11/023
USPC ..... 4/432, 433
See application file for complete search history.

(56) References Cited

U.S. PATENT DOCUMENTS 3,247,525 A * 4/1966 O'Brien ..... 4/438
3,323,650 A * 6/1967 Kilbane, Jr. ..... 210/173

(Continued)

FOREIGN PATENT DOCUMENTS

EP 1972728 9/2008

*Primary Examiner* — Janie Christiansen
(74) *Attorney, Agent, or Firm* — Marcus C. Dawes; Daniel L. Dawes

(57) ABSTRACT

A pump assembly for connection with a water source inlet (4), a sewer outlet (5) and a toilet (1), said toilet (1) comprising a toilet flush water inlet (2) and a toilet waste outlet (3), said pump assembly comprising: a pump housing with a pump flush water inlet (27), a pump flush water outlet (28), a pump waste inlet (25) and a pump waste outlet (26), and with means arranged to selectively allow water to flow from said pump flush water inlet (27) to said pump flush water outlet (28), and with means arranged to selectively pump waste from said pump waste inlet (25) to said pump waste outlet (26), characterized in that said pump assembly further comprises a connection system comprising two connection members (6, 7) that can be connected to each other: said first connection member (6) comprising a toilet waste outlet port (21) arranged to be connected to said toilet waste outlet (3), and a sewer outlet port (20) arranged to be connected to said sewer outlet (5), said second connection member (7) comprising said pump waste inlet port (25) and said pump waste outlet port (26), wherein in the connected state of said connection members (6, 7) said respective ports (20, 25) on said first connection member (6) are arranged in alignment and in watertight communication with the corresponding respective ports (21, 26) on said second connection member (7), such that said respective pairs of ports (20, 25; 21, 26) are connected or disconnected from each other simultaneously by connecting or releasing said second connection member (7) to/from said first connection member (6).

16 Claims, 6 Drawing Sheets

(56) References Cited

U.S. PATENT DOCUMENTS 3,514,231 A * 5/1970 Belden et al. ..... 417/565
4,333,185 A * 6/1982 Heinze et al. ..... 4/319
6,421,843 B1 * 7/2002 Mellinger et al. ..... 4/319
2007/0192951 A1 * 8/2007 Durrani et al. ..... 4/420
2008/0216905 A1 * 9/2008 Dorsey et al. ..... 137/565.11
2009/0092505 A1 * 4/2009 Cohoon et al. ..... 417/393

* cited by examiner

PUMP ASSEMBLY FOR A MARINE TOILET AND TOILET PUMP CONNECTION SYSTEM

The invention relates to a pump assembly for a toilet, in particular a marine toilet. More in particular the invention relates to a pump assembly for connection with a water source inlet, in particular a boat's flushing water inlet, a sewer outlet, in particular a boat sewer outlet, and a toilet, said toilet comprising a toilet flush water inlet and a toilet waste outlet, said pump assembly comprising a pump housing with a pump flush water inlet, a pump flush water outlet, a pump waste inlet and a pump waste outlet, and with means arranged to selectively allow water to flow from said pump flush water inlet to said pump flush water outlet, and with means arranged to selectively pump waste from said pump waste inlet to said pump waste outlet. The invention is applicable to both manual and motor driven (electrical) pumps.

Such a pump assembly is described in U.S. 2008/0216225. Marine toilet pumps regularly fail. If the pump assembly needs maintenance or needs to be replaced, the respective inlets and outlets have to be disconnected from each other one by one, and the pump dismounted from its base, requiring various tools and substantial expertise. A further disadvantage of the known pumps is that during these tasks sewer material leaks from the hoses and tubes, and therefore maintenance or replacement of these pump assemblies is not a very popular job. Often users hire plumbers to do the job, who are not always available and have to be paid. The invention aims at a pump assembly, which is easier and/or less unappealing to maintain and/or replace.

To that end said pump assembly further comprises a connection system comprising two connection members that can be connected to each other: said first connection member comprising a toilet waste outlet port arranged to be connected to said toilet waste outlet, and a sewer outlet port arranged to be connected to said sewer outlet, said second connection member comprising said pump waste inlet port and said pump waste outlet port, wherein in the connected state of said connection members said respective ports on said first connection member are arranged in alignment and in watertight communication with the corresponding respective ports on said second connection member, such that said respective pairs of ports are connected or disconnected from each other simultaneously by connecting or releasing said second connection member to/from said first connection member. Thereby a quick connect ("plug-and-play") pump assembly is obtained, wherein the two connection members can be latched to each other without tools or expertise.

Preferably said first connection member further comprises a water source inlet port to be connected to said water source inlet, a water source outlet port to be connected to said toilet flush water inlet, and said second connection member further comprises said pump flush water inlet port, said pump flush water outlet port.

Preferably said second connection member is rigidly connected to said pump housing. Preferably said pump assembly is arranged such that, while connected to the first connection member, the pump housing extends substantially above said second connection member. Preferably said pump assembly is arranged such that, while connected to the first connection member, the ports on said second connection member extend downward. Preferably said first connection member comprises mounting means for mounting said connection member to a fixed object such as a toilet, a floor or a wall, such that the ports on said first connection member extend upward.

Preferably said respective ports on said first connection member and on said second connection member are arranged in one row. Preferably said first connection member and said second connection member comprise latching means, such as latches or toggles, for releasably connecting said two members manually without tools. Preferably said connection members are arranged such that the respective pairs of ports are disconnected from each other by moving said second connection member away from said first connection member substantially in the direction of the axes of said ports.

Preferably said system further comprises a lid, said lid comprising blind ports matching the ports on said second connection member, wherein the blind ports on said lid are arranged in alignment with the corresponding respective ports on said second connection member, such that said respective ports can be closed or opened for transport. In this manner the user can easily attach the lid to the pump assembly, and dispose the pump with the lid at his/her convenience without leakage of sewer material.

Preferably said first connection member is provided with two drain openings and a drain connected to said drain openings, said drain openings being located in said toilet waste outlet port and said sewer inlet port respectively, such that if the respective pairs of ports on said connection members are connected to each other said drain openings are closed, and if the second connection member is partially released from the first connection member said drain openings are open such that the toilet waste outlet port and the sewer inlet port are drained. Preferably the latching means are formed such that they provide an intermediate drain position wherein the drain openings are open, but the connection members are not fully released from each other. When a user puts the other end of the drain in a container and then disconnects the second connection member from the first connection member, the waste outlet port and the sewer inlet port are automatically drained, whereby the chance of flooding is eliminated when the connection is eventually fully released.

According to one aspect of the invention said pump housing with said pumping means are detachably connected to said base connection member with said motor and said driven shaft. The motor is one of the more expensive parts of the pump, which with prior art pumps can be a reason for a user not to dispose the pump but to repair or clean the pump. With the pump assembly of the invention, in case of failure of the pump the pump housing can be detached from the base connection member fitted with said motor, and the pump housing can then simply be disposed or recycled while the motor can continue to be used with a replacement housing with pumping means.

The invention also relates to the pump connection system as described above, and in particular to a toilet pump connection system comprising a first connection member and a second connection member, said first connection member comprising at least two ports, each of said at least two ports being in communication with an outlet on said first connection member, said outlets being arranged to be connected to respectively a sewer outlet and a toilet waste outlet; and said second connection member comprising at least two ports, each of said at least two ports being in communication with an inlet on said first second connection member, said inlets being arranged to be connected to respectively a pump waste inlet and a pump waste outlet of a pump housing; wherein in the connected state of said connection members said respective ports on said first connection member are arranged in alignment and in watertight communication with the corresponding respective ports on said second connection member, such that said respective pairs of ports are connected or disconnected from each other simultaneously by connecting or releasing said second connection member to/from said first connection member.

The invention will be elucidated by the following description of a preferred embodiment, as shown in the drawings, wherein.

Figure 1:
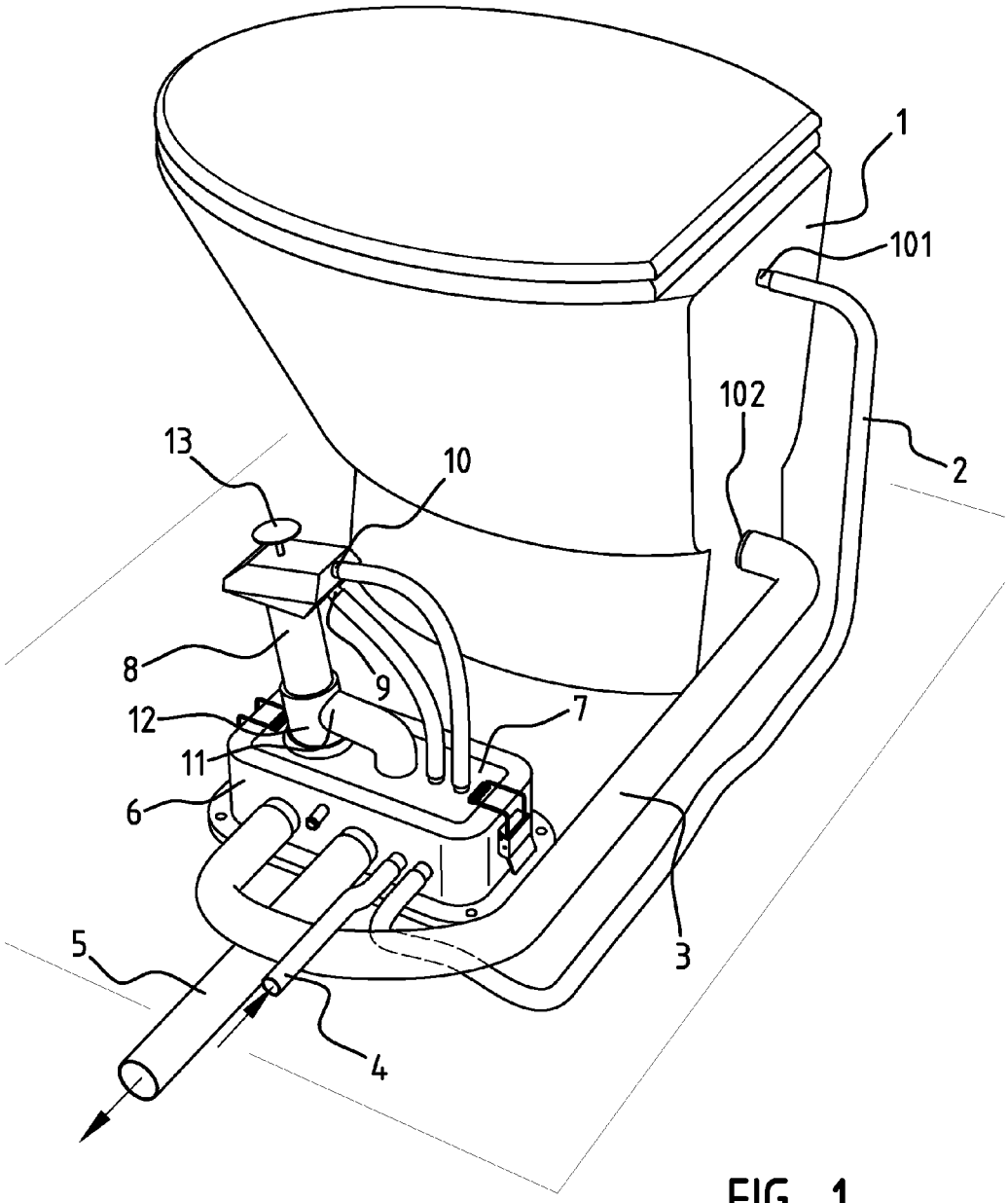
FIG. 1 is a perspective view of a toilet with a pump assembly.

According to FIG. 1 a pump assembly is connected at one side to a marine toilet 1, having a flush water inlet 101 and a waste outlet 102, by a flush water inlet hose 2 and a toilet waste outlet hose 3. On the other side the pump assembly is connected to a water source inlet hose 4 and a sewer outlet hose 5.

The pump assembly comprises a first (base) connection member 6, a second (pump) connection member 7 and a pump 8. The pump 8 is a well known device, comprising a housing with means (not shown) for pumping water in its upper portion and means (not shown) for pumping waste material in its lower portion. To that end the housing has a flush water inlet 9, flush water outlet 10, a waste outlet 11 and a waste inlet 12. The pump 8 further comprises a pump handle 13 at its upper side.

Figure 2:
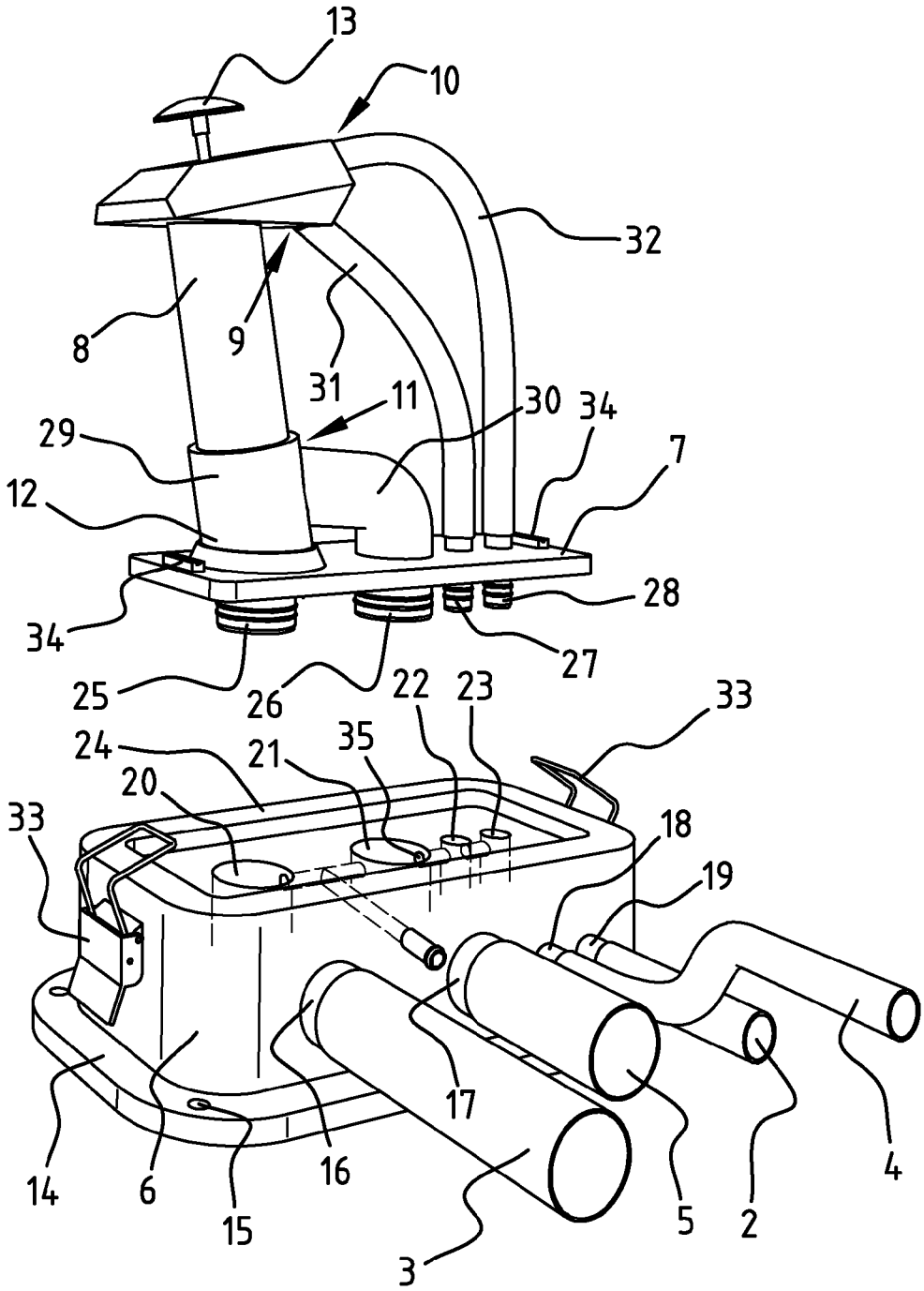
FIG. 2 is a perspective view of the pump assembly of FIG. 1 in the disconnected state.
Figure 3C:
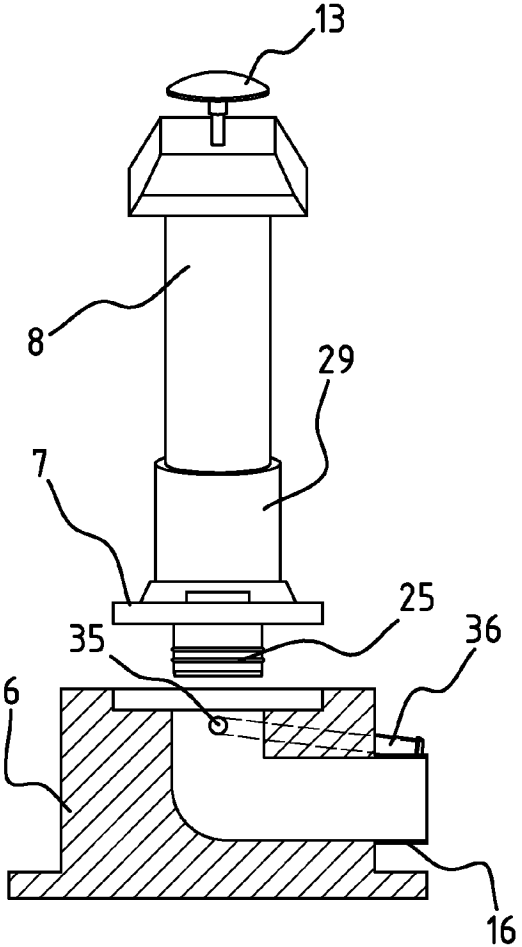
FIGS. 3A, 3B and 3C is a partial cross section through one of the ports of the pump assembly of FIG. 1 in three phases of connection (respectively locked, drain and released)
Figure 3B:
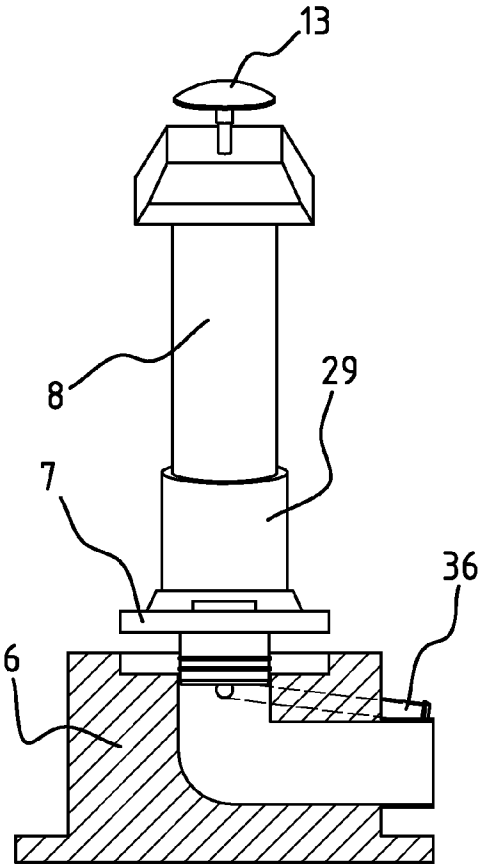
Figure 3A:
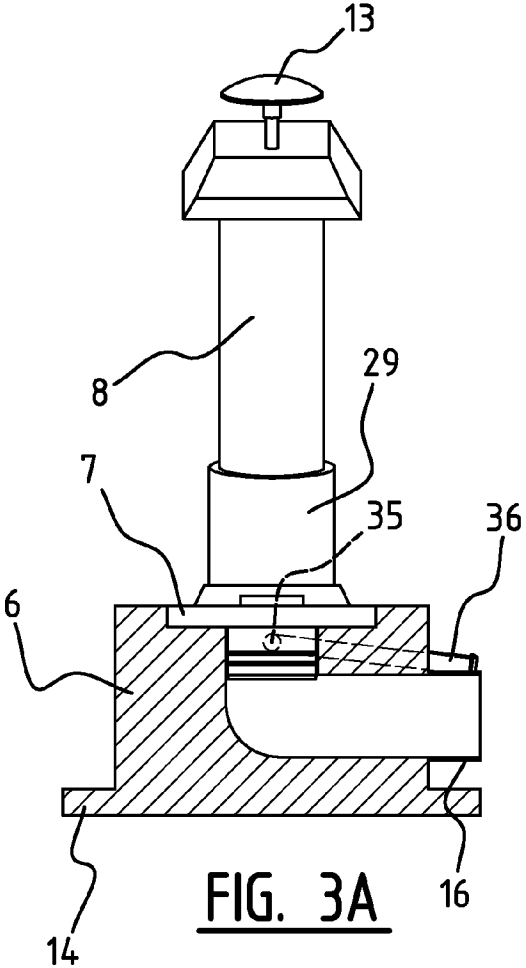

As shown in FIG. 2, the first (base) connection member 6 comprises a box shaped housing with a flange 14 around its lower periphery, with mounting holes 15 for screwing the base connection member 6 to the floor of a boat. The housing of base connection member 6 comprises four ports in the form of tubes, each tube with one opening in the upper wall of the housing and the other opening in one of the side walls of the housing. The openings in the side wall of the housing are formed by protruding tube ends such that the respective tubes 2, 3, 4, 5 can be easily connected, and form, from left to right, a sewer inlet port 16, a toilet waste outlet port 17, a water source inlet port 18 and a flush water outlet port 19. The openings in the upper wall of the housing form from left to right a sewer outlet port 20, a toilet waste inlet port 21, a water source outlet port 22 and a flush water inlet port 23.

The second (pump) connection member 7 comprises a plate which can rest on top of the upper wall of the base connection member 6. The upper wall of the base connection member 6 has an upright peripheral edge 24, which surrounds the edge of the plate of the pump connection member 7. The plate comprises four openings. At one side of the plate the ports are formed by protruding tube ends. Said tube ends are provided with flexible O-rings, for instance of rubber. The tube ends form, from left to right, a waste inlet port 25, a waste outlet port 26, a flush water inlet port 27 and a flush water outlet port 28. The outer diameters of the respective tube ends 25, 26, 27, 28 and the rubber rings thereon are such that they tightly fit in the respective ports 20, 21, 22, 23 of the base connection member. The location of these ports 20, 21, 22, 23; 25, 26, 27, 28 are such that the respective pairs of ports 20 and 25; 21 and 26; 22 and 27; 23 and 28 are aligned with each other, so that the ports of the pump connection member can be inserted into the ports of the base connection member in one move.

The waste outlet port 11 and a waste inlet port 12 of the pump 8 are rigidly connected to the respective openings on the other side of pump connection member 7 by tubes 29, 30 and suitable connection means, such that the pump and the pump connection member form one rigid body, which his easy to handle. The flush water inlet port 9 and flush water outlet port 10 are connected to the respective openings by hoses 31, 32. These hose connections can also form part of the rigid pump body.

The base connection member 6 and the pump connection member 7 are provided with co-operating latch means 33, 34, such that the members 6, 7 can be connected to and disconnected from each other without any tools or expertise.

The ports 20, 21, 23, 24 are provided with drain openings 35 in their cylindrical side walls, at a distance below the upper wall of the base connection member. These openings are all mutually connected by descending tubes, which end in a drain port 36 in the side wall of the base connection member, to which a flexible drain tube can be connected.

Figure 4:
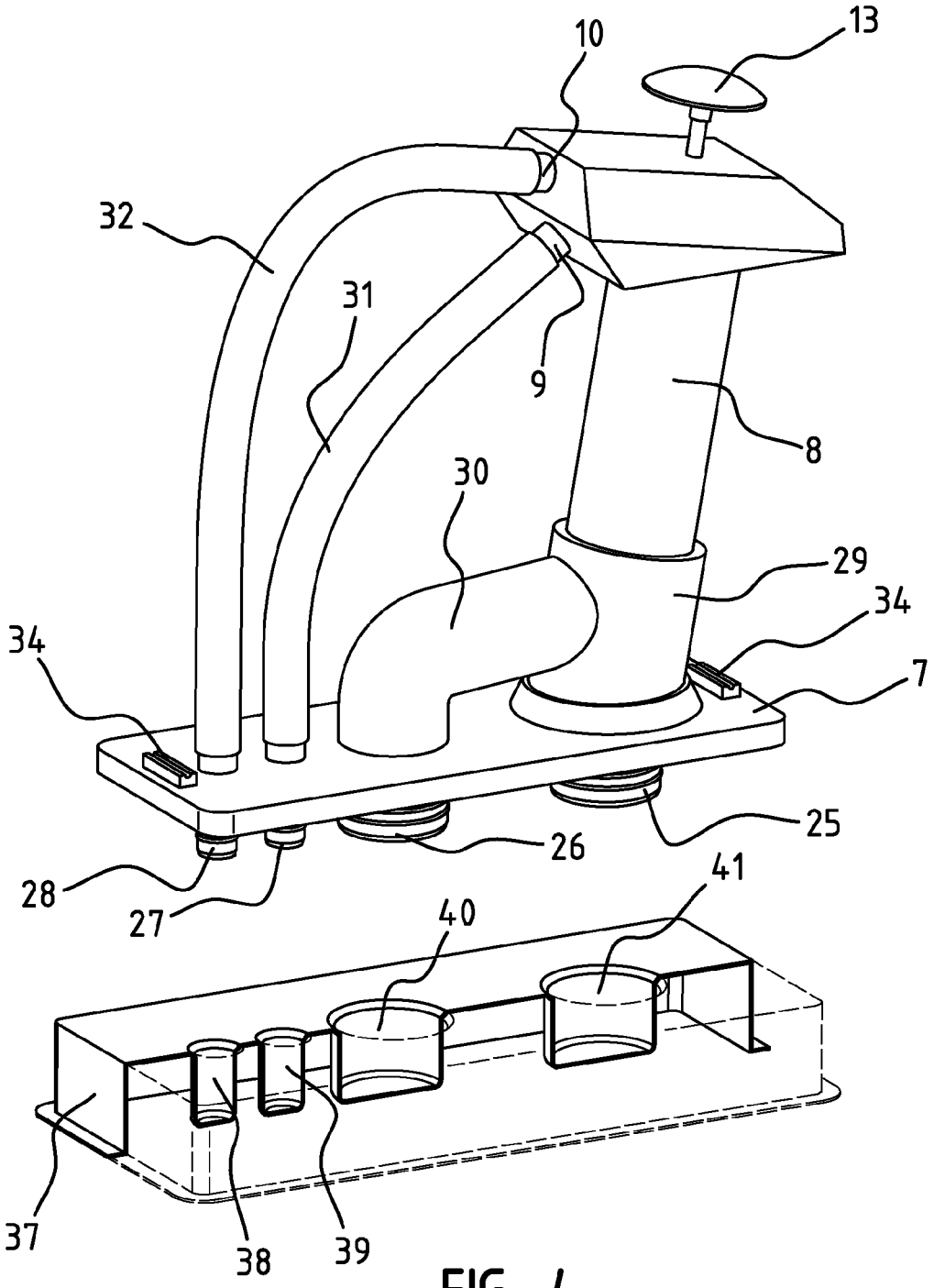
FIG. 4 is a perspective view in partial cross section of the pump assembly of FIG. 1 and a disposal lid.

In FIG. 4 a lid 37 is shown, comprising a housing with four blind ports 38, 39, 40, 41, which are closed at the bottom. The diameters and location of the blind ports in the lid 37 correspond exactly to the diameters and location of the ports 20, 21, 22, 23 in the base connection member.

Figure 5:
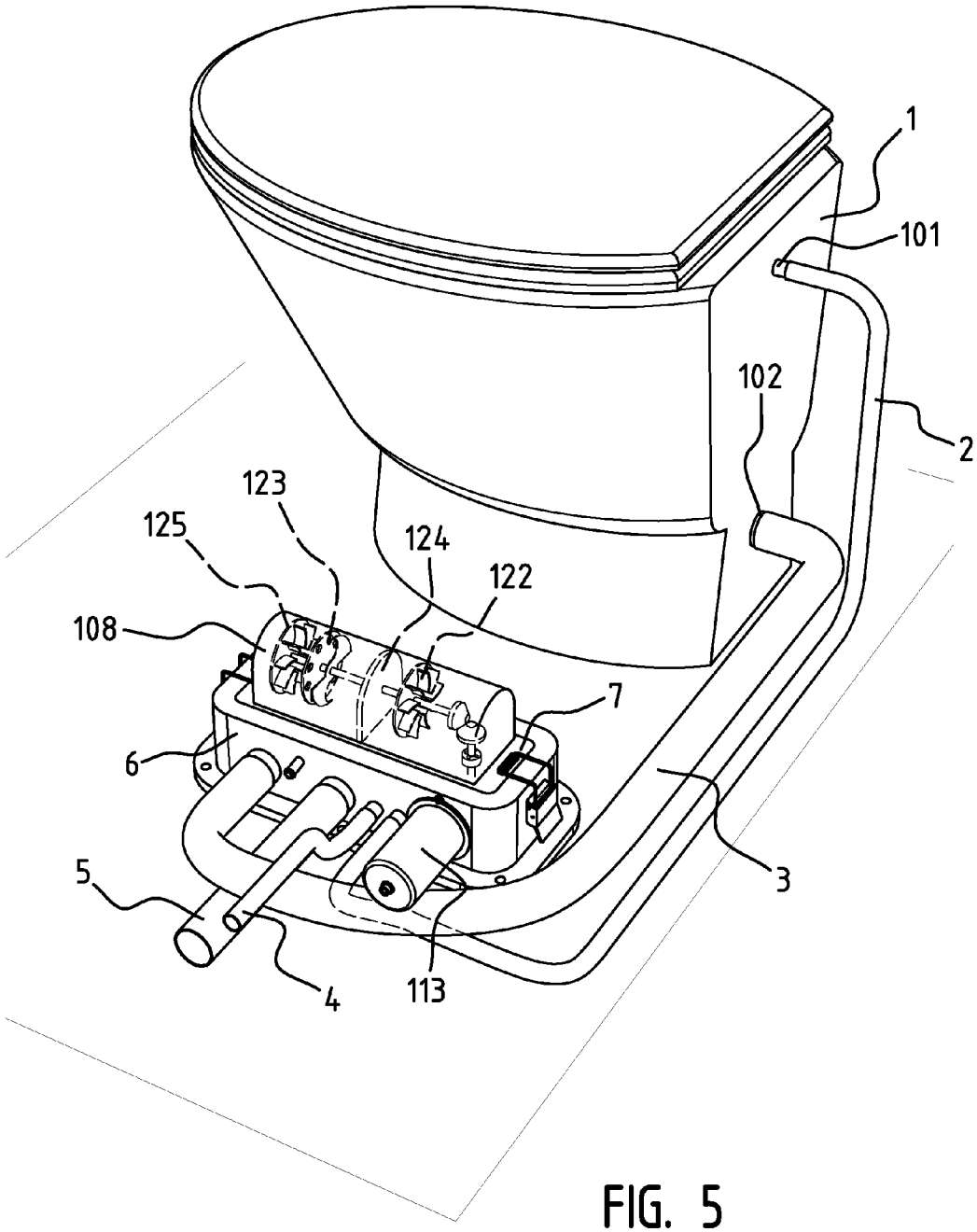
FIG. 5 is a perspective view of a second embodiment of a toilet with an electrical pump assembly.

According to FIG. 5 the pump assembly is to a large extent identical to the assembly of FIGS. 1-4. However, the pump housing 108 is formed integrally with the pump connection member 7, and forms an elongated enclosure extending substantially in horizontal direction. The base connection member 6 is provided with an electromotor 113, which is attached to the same side wall where the ports 16, 17, 18, 19 are provided, with its driving shaft 114 extending horizontally in the interior of base connection member 6. At the outer end of the shaft 114 a bevel gear wheel 115 is mounted. In the interior of the base connection member 6 also a vertical shaft is rotationally mounted, having a second bevel gear wheel 116 at its lower end which mates with the bevel gear wheel 115, and a female connection piece 117 at its upper end, having a non-circular opening extending in axially upward direction. The base connection member 6 is provided with a driving shaft port 42 through which the connection piece 117 can be mated. The axis of the driving shaft port 42 extends parallel to and in line with the ports 20, 21, 22, 23 in the upper wall of the base connection member 6.

In the interior of pump housing 108 a vertical shaft is rotationally mounted, having a male connection piece 118 at its lower end, and a bevel gear wheel 119 at its upper end. The male connection piece 118 fits in the opening of female connection piece 117 in a releasable manner. Further a horizontal shaft 121 is rotationally mounted in the pump housing 108, having at its outer end a bevel gear wheel 120 which mates with bevel gear wheel 119. The shaft 121 runs through a bearing in a dividing wall 124 which separates the flush water part of the pump with the waste part of the pump. The shaft 121 is provided with a water pump rotor 122 and a waste pump macerator 123 and pump 125 in the respective parts. It should be noted that the interior of the pump housing 108 is only schematically shown and that not all internal parts of the pump 108 are shown, as such a water pump and waste macerator pump is well known in the art.

Figure 6:
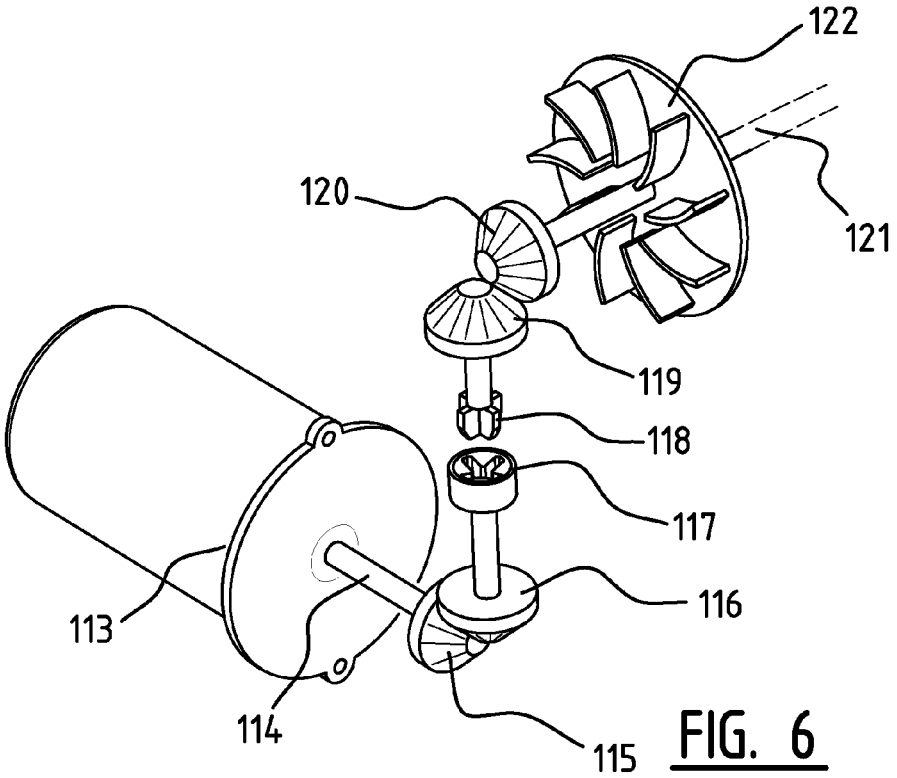
FIG. 6 is a perspective view of the electric motor and transmission means used in the pump assembly of FIG. 5.
Figure 7:
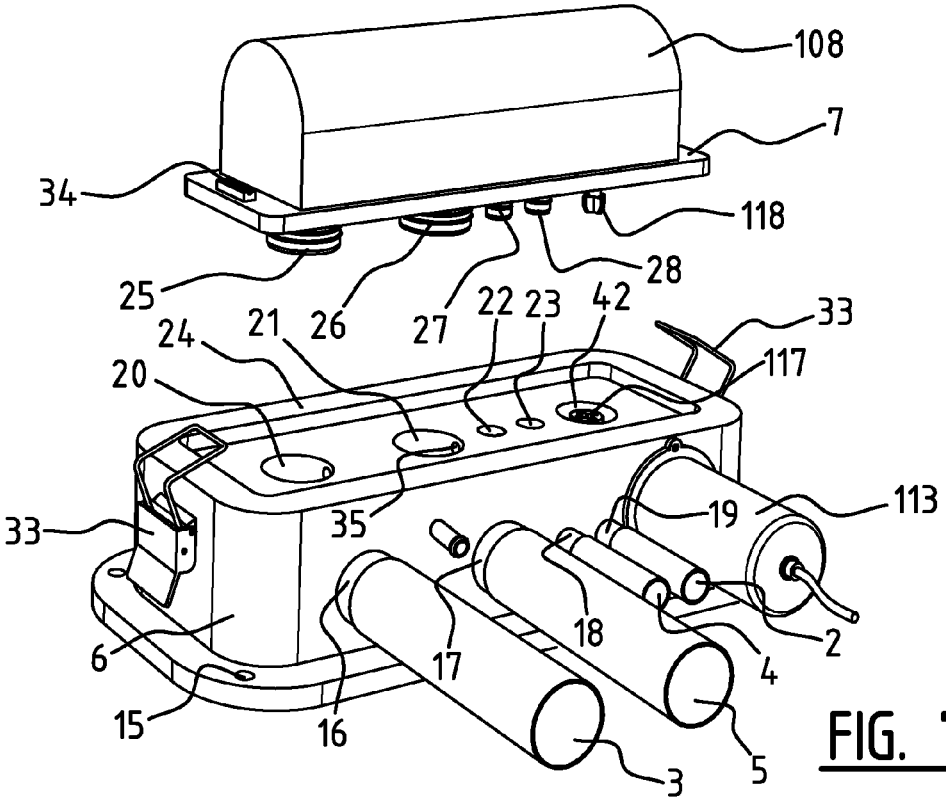
FIG. 7 is a perspective view of the pump assembly of FIG. 5 in the disconnected state.

The system as shown in FIGS. 5-7 can further be provided with a lid 37 as shown in FIG. 4, wherein an additional blind port (not shown) for accommodating the male connection piece 108 is provided in a similar manner.

The pump housing 108 with the pump connection member can be easily disconnected from the motor 113 by releasing the co-operating latch means 33, 34 and moving the male connection piece 118 upward and out of the female connection piece 117. In the same move ports 25, 26, 27, 28 are disconnected from ports 20, 21, 22, 23. Connection of a new or maintained pump housing 108 to the base connection member 6 can be achieved in the reverse manner.

Although the invention is exemplified by one embodiment thereof, the scope of the current teaching is not restricted to said embodiment. The skilled person will appreciate that many modifications can be made and that equivalent features may substitute the described features without departing from the teachings of the invention.

The invention claimed is:

1. A pump assembly for connection with a water source inlet, a sewer outlet and a toilet, said toilet comprising a toilet flush water inlet and a toilet waste outlet, said pump assembly comprising:

a pump housing with a pump flush water inlet port, a pump flush water outlet port, a pump waste inlet port and a pump waste outlet port, and with means arranged to selectively allow water to flow from said pump flush water inlet to said pump flush water outlet, and with means arranged to selectively pump waste from said pump waste inlet to said pump waste outlet;

wherein said pump assembly further comprises a connection system comprising a first and a second connection member that can be connected to each other:

wherein said first connection member comprises a toilet waste outlet port arranged to be connected to said toilet waste outlet, and a sewer outlet port arranged to be connected to said sewer outlet, and wherein said second connection member comprises said pump waste inlet port and said pump waste outlet port, wherein in the connected state of said first and second connection members said respective ports on said first connection member are arranged in alignment and in watertight communication with the corresponding respective ports on said second connection member, such that said respective pairs of ports are connected or disconnected to/from each other simultaneously by connecting or releasing said second connection member to/from said first connection member.

2. The pump assembly in accordance with claim 1 further comprising:

wherein said first connection member further comprises a water source inlet port to be connected to said water source inlet;

a water source outlet port to be connected to said toilet flush water inlet; and wherein said second connection member further comprises said pump flush water inlet port and said pump flush water outlet port.

3. The pump assembly in accordance with claim 1, wherein said second connection member is rigidly connected to said pump housing.

4. The pump assembly in accordance with claim 1, wherein said pump assembly is arranged such that, while connected to the first connection member, the pump housing extends substantially above said second connection member.

5. The pump assembly in accordance with claim 1, wherein said pump assembly is arranged such that, while connected to the first connection member, the ports on said second connection member extend downward.

6. The pump assembly in accordance with claim 1, wherein said first connection member comprises mounting means for mounting said connection member to a toilet, a floor or a wall, such that the ports on said first connection member extend upward.

7. The pump assembly in accordance with claim 1, wherein said respective ports on said first connection member and on said second connection member are arranged in one row.

8. The pump assembly in accordance with claim 1, wherein said first connection member and said second connection member comprise latching means for releasably connecting said two members manually without tools.

9. The pump assembly in accordance with claim 1, wherein said connection members are arranged such that the respective pairs of ports are disconnected from each other by moving said second connection member away from said first connection member substantially in the direction of the axes of said ports.

10. The pump assembly in accordance with claim 1, wherein said system further comprises a lid, said lid comprising blind ports matching the ports on said second connection member, wherein the blind ports on said lid are arranged in alignment with the corresponding respective ports on said second connection member, such that said respective ports can be closed or opened for transport.

11. The pump assembly in accordance with claim 1, wherein said first connection member is provided with two drain openings and a drain connected to said drain openings, said drain openings being located in said toilet waste outlet port and said sewer inlet port respectively, such that if the respective pairs of ports on said connection members are connected to each other said drain openings are closed, and if the second connection member is partially released from the first connection member said drain openings are open such that the toilet waste outlet port and the sewer inlet port are drained.

12. A toilet pump connection system comprising:

a first connection member and a second connection member, said first connection member comprising at least two ports, each of said at least two ports being in communication with respective outlets on said first connection member, said outlets being arranged to be connected respectively to a sewer outlet and a toilet waste outlet; and said second connection member comprising at least two ports, each of said at least two ports being in communication with respective inlets on said second connection member, said inlets being arranged to be connected respectively to a pump waste inlet and a pump waste outlet of a pump housing;

wherein in the connected state of said connection members and said respective ports on said first connection member are arranged in alignment and in watertight communication with the corresponding respective ports on said second connection member, such that said respective pairs of ports are connected or disconnected from each other simultaneously by releasing said second connection member from said first connection member.

13. The toilet pump connection system in accordance with claim 12, wherein said first connection member further comprises a water source inlet port to be connected to a water source inlet tube, a water source outlet port to be connected to a toilet flush water inlet tube, and said second connection member further comprises a pump flush water inlet port, and a pump flush water outlet port.

14. The pump assembly in accordance with claim 1, wherein said first connection member comprises a motor a rotationally driven shaft, wherein said pumping means are connected to said rotationally driven shaft, and wherein said pump housing comprising said pumping means are detachably connected to said first connection member comprising said motor and said driven shaft.

15. The pump assembly in accordance with claim 14, wherein said pump housing comprises a second rotationally driven shaft connected to said pump means, wherein said respective ports and said shaft on said first connection member are arranged in alignment with the corresponding respective ports and said second shaft on said pump housing, such that said respective pairs of ports and said shafts can be connected or disconnected from each other simultaneously by connecting or releasing the two connection members.

16. The pump assembly in accordance with claim 14, wherein said respective ports and said shaft are arranged in one row.

* * * * *